US005435082A

United States Patent [19]

Frenette et al.

[11] Patent Number: 5,435,082

[45] Date of Patent: Jul. 25, 1995

[54] SNOW PLOW STABILIZER DEVICE

[76] Inventors: Eugene R. Frenette; Henry E. Frenette; Dana E. Frenette, all of 350 A Mt Rd., Northwood, N.H. 03261

[21] Appl. No.: 105,289

[22] Filed: Aug. 10, 1993

[51] Int. Cl.[6] ..... E01H 5/06

[52] U.S. Cl. ..... 37/235; 37/231; 37/234; 37/236; 172/668; 172/674; 172/795; 172/828; 172/829

[58] Field of Search ..... 37/231, 232, 234, 235, 37/236; 172/668, 674, 683, 795, 828, 829

[56] References Cited

U.S. PATENT DOCUMENTS 4,215,494 8/1980 Farrell et al. ..... 37/236

4,680,880 7/1987 Boneta ..... 37/236

*Primary Examiner*—Andrea Chop

*Attorney, Agent, or Firm*—Davis, Bujold & Streck

[57] ABSTRACT

An apparatus, for stabilizing a plowing implement mounted on a motor vehicle, comprising a rigid stabilizer member having first and second opposed ends. One end of the stabilizer member supports an attachment device for attaching the stabilizer member to a plowing frame secured to a motor vehicle. The attachment device allows pivoting motion of the stabilizer member relative to the plowing frame. The second end of the stabilizer member has an abutment surface for abutting against a pivotable portion of the plowing implement when the plowing implement is raised into travel position. The stabilizer member is pivotable into an inoperative position where complete freedom of movement of the plow is achieved and an operative position by a control mechanism. When the stabilizer member is in its operative position, the abutment surface abuts against a pivotable portion of the plowing implement to minimize undesired bouncing of the plowing implement while the vehicle is traveling on a roadway.

15 Claims, 4 Drawing Sheets

SNOW PLOW STABILIZER DEVICE

FIELD OF INVENTION

This invention relates to a device for stabilizing an snow plowing implement mounted on a motor vehicle, in particular, a device for preventing a snow plow from bouncing when in a partially raised travel position while driving along the road.

BACKGROUND OF THE INVENTION

In order to drive along a roadway between plowing sites, the operator of a vehicle typically partially raises the snow plow, or other front-end implement, high enough to clear the roadway surface but not so high that the partially raised plowing implement obstructs the driver's view or severely obstructs the flow of cooling air past the plowing implement into the radiator of the vehicle.

Many plows are raised by a chain whose first lower end is attached to a hook supported by an intermediate pivotable section of the plow and whose second upper end is attached to another hook supported by an outer end of a pivot member. A hydraulic cylinder or electric motor, controlled by a control mechanism and activated by the operator, is attached to the pivot member for raising and lowering the pivot member and thereby the plow as desired.

When driving down a bumpy road or over a "pot" hole or other road surface undulation, a chain supported plow typically bounces up into the air from its partially raised position, thereby creating some slack in the chain, and then the plow comes jerking down pulling the chain taut. The amount of slack generated in the chain is dependent upon a number of factors such as the vehicle speed, the vehicle suspension system, the magnitude of the bump or undulation, etc.

If sufficient slack is generated in the chain upon driving over an undulation in the road surface, such chain slack may occasionally cause an unhitching of either the upper or lower end of the chain from one of the hooks. If the bouncing up and down of the plow was not sufficient to cause an unhitching of the chain from the hooks, such bouncing eventually leads to premature chain fatigue and/or chain failure which may occur while driving down the roadway. In either event, if the vehicle is in motion when the chain brakes or unhitches, the plow crashes down onto the roadway. Not only does this cause damage to the lower longitudinal edge of the plow, as the plow slams into the road surface and is subsequently pushed therealong, but the plow may possibly get jammed into the roadway stopping the vehicle suddenly or quickly slowing down the vehicle. The unexpected release of the snow plow perhaps causing an accident thereby injuring the driver or any passenger(s) in the vehicle and/or damaging the plow, the plow mounting structure, or the vehicle.

SUMMARY OF THE INVENTION

The invention relates to an apparatus, for stabilizing a plowing implement mounted on a motor vehicle, comprising a rigid stabilizer member having first and second opposed ends; an attachment device supported by the first end of said stabilizer member for attaching said stabilizer member to a plowing frame secured to a motor vehicle, said attachment device allowing pivoting motion of said stabilizer member; and the second end of said stabilizer member having an abutment surface for abutting against a pivotable portion of said plowing implement when said plowing implement is raised to a travel position whereby when said stabilizer member abuts against a pivotable portion of said plowing implement, said stabilizer member minimizes undesired bouncing of the plowing implement, from said travel position, while the vehicle is traveling on a roadway.

The invention further relates to an apparatus, for stabilizing a plowing implement mounted on a motor vehicle, in combination with a plowing implement comprising a vertical mounting frame securable to a front end of a vehicle by suitable attachment means, an upper end portion of said vertical mounting frame having a first end of a pivot member pivotably mounted thereto while said second end of said pivot member supports a first hook, a lower end portion of said vertical mounting frame having a first end of a pivotable section pivotably mounted thereto while an intermediate section of said pivotable section supports a second hook, said second end of said pivotable section supporting said plowing implement, a first end of a hydraulic cylinder is pivotably mounted to said vertical mounting frame while a second end of said hydraulic cylinder is connected to said second end of said pivot member, and a chain interconnects said first and second hooks.

The invention finally relates to a method of stabilizing a plowing implement mounted on a motor vehicle comprising the steps of employing a rigid stabilizer member having first and second opposed ends; pivotably attaching said first end of said stabilizer member to a plowing frame secured to a motor vehicle; providing said second end of said stabilizer member with an abutment surface for abutting against a pivotable portion of said plowing implement when said plowing implement is raised to a travel position, moving said stabilizer member into an operative position; and raising said plowing implement to its travel position so that said abutment surface abuts against a pivotable portion of said plowing implement thereby to minimize undesired bouncing of said plowing implement, from said travel position, while the vehicle is traveling on a roadway.

BRIEF DESCRIPTION OF THE DRAWINGS

The invention will now be described, by way of example, with reference to the drawings in which.

DETAILED DESCRIPTION OF THE INVENTION

Figure 1:
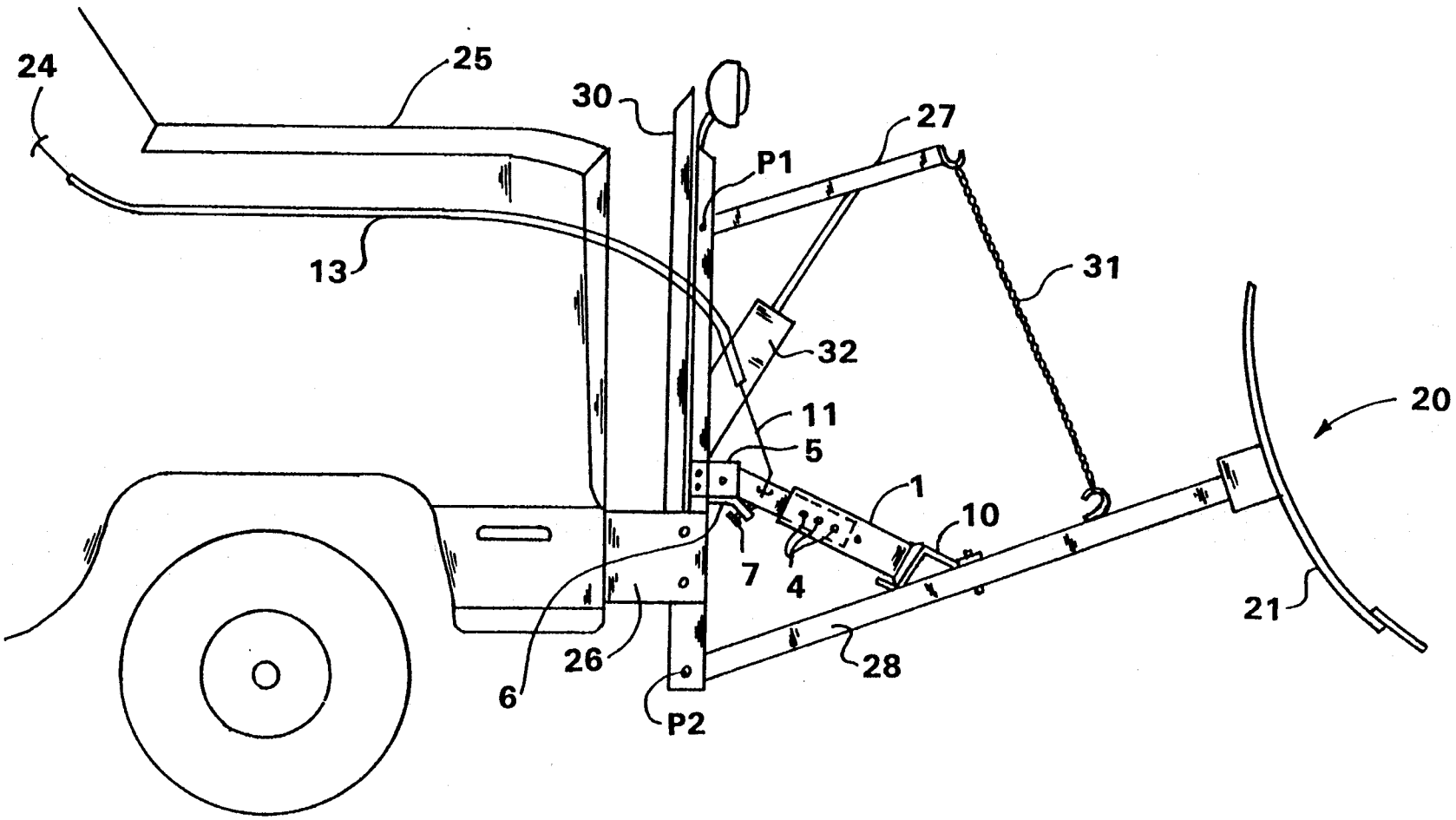
FIG. 1 is a diagrammatic side elevational view of a stabilizer member according to the present invention in combination with a plow mounted on the front end of a motor vehicle.

FIG. 1 shows a stabilizer member, generally indicated as 1, in combination with a plowing implement 20 and a vehicle 25. The plowing implement 20 comprises a vertical mounting frame 30 which is securely fastened to the front end of the vehicle 25 by a suitable attachment device 26. An upper end portion of the vertical mounting frame 30 has a first end of a pivot member 27 pivotably mounted thereto at P1 while the second end of the pivot member 27 supports a hook. The lower end portion of the vertical mounting frame 30 has a first end of a pivotable section 28 pivotably mounted thereto at P2 while an intermediate section of the pivotable section 28 supports a second hook. The second end of the pivotable section 28 supports the plowing implement 21, such as a blade. A first end of a chain 31 is connected to the first hook and the second end of the chain is connected to the second hook. A first end of a hydraulic cylinder 32 is pivotably mounted to an intermediate portion of the vertical mounting frame 30 while a second end of the hydraulic cylinder 32 is connected to the second end of the pivot member 27. As such plowing elements are conventional and well known in this art, they are not discussed any further in detail.

A first end of the stabilizer member 1 is pivotally mounted to an intermediate portion of the vertical mounting frame 30 by a pivot or other suitable hinge member 5. It is to be appreciated that the basic requirement of the hinge member 5 is to allow the stabilizer member 1 to have a limited range of pivoting motion, in a vertical plane, between about 10 and 90 degrees, preferably about 45 degrees, so that the stabilizer member 1 can pivot about the hinge member 5 into and out of its inoperative plowing and operative travel positions, which will be discuss further in detail below.

Figure 2:
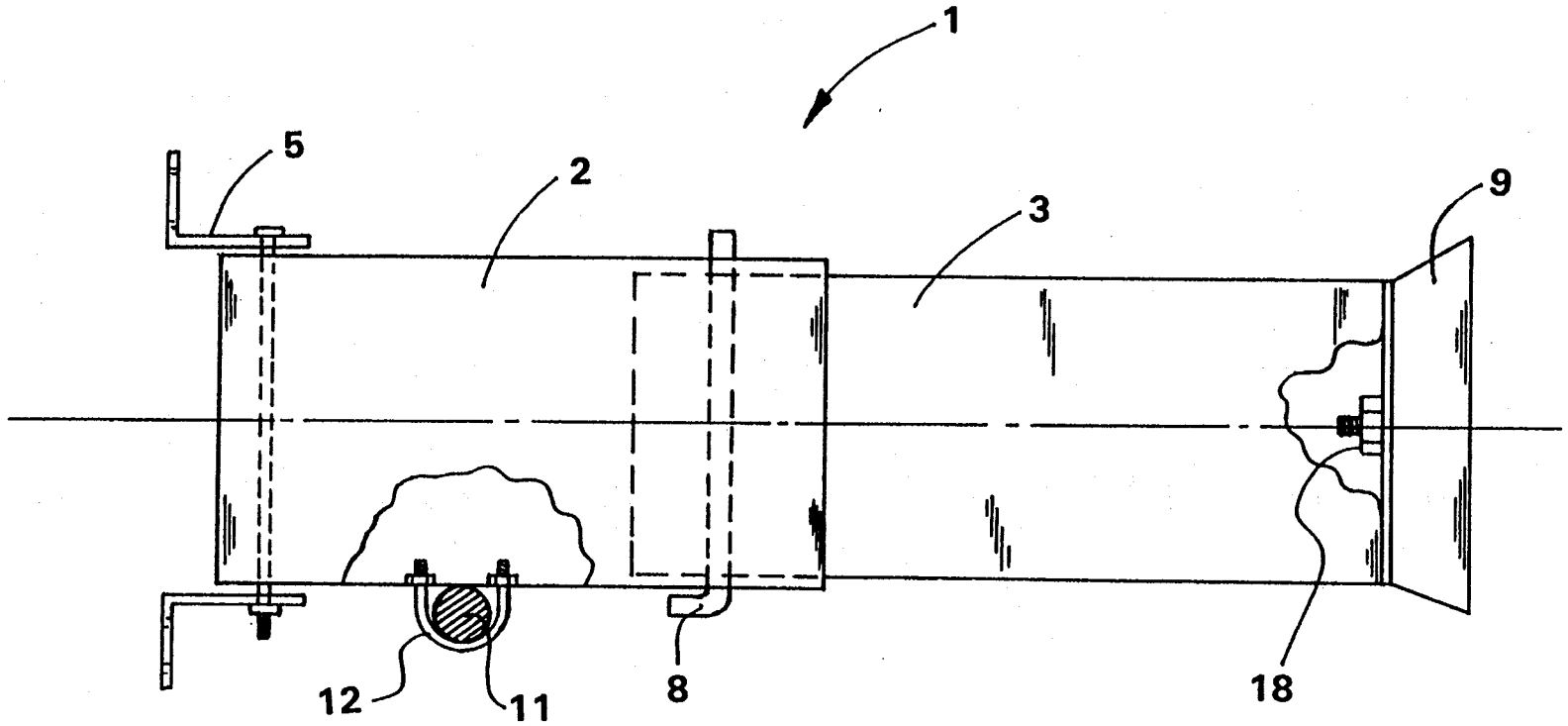
FIG. 2 is a partial cross-section, partially broken away top view of a stabilizer member according to the invention.

The stabilizer member 1 (FIG. 2) comprises a telescoping member including an outer sleeve 2 and an inner sleeve 3. The inner sleeve 3 telescopically slides within the outer sleeve 2 to adjust the stabilizer member's length. The outer sleeve 2 has a plurality of length adjustment members or holes 4, as can be seen in FIG. 1, passing transversely through the outer sleeve 2. The inner sleeve 3 has at least one length adjustment member or hole passing transversely therethrough for selective alignment with a desired one of the holes 4 in the outer sleeve 2. An adjusting bolt, pin or other securing member 8 is sized to extend completely through the aligned holes of the outer and inner sleeves and thereby prevent relative movement between those two sleeves. The length of the stabilizer member 1 is adjusted by aligning at least one hole in the inner sleeve 3 with a desired hole in the outer sleeve 2 and inserting pin 8 through the outer and inner sleeves thereby locking the two sleeves together at a desired length.

Because of the length adjustment, the stabilizer member 1 is readily attachable to various designs and types of plows. The stabilizer member's length is adjusted, prior to use, to adjust the raised travel position of the plow. It is to be appreciated that the type of stabilizer member 1 employed may vary depending upon the type of plow. The stabilizer member could comprise a first sleeve having an exterior thread and a second sleeve having an interior mating thread which when threaded together may be locked in place by a locking nut to provide a variable adjustment of the stabilizer member's length. Alternatively, the stabilizer member may be of a fixed length.

In FIG. 1, the stabilizer member 1 is shown in its lowered operative position in which the second end of the stabilizer member abuts against a stop bracket 10, mounted on an intermediate portion of the pivotable section 28, as the plow 20 is raised by the control mechanism into its travel position, i.e. the second end of the stabilizer member 1 abuts against the stop bracket 10. The travel position is selected such that the plowing implement 21 is below the driver's line of vision and allows suitable air flow past the plowing implement 21 to the vehicle radiator while being high enough to clear any obstruction of the road surface while traveling down a roadway.

As the cylinder 32 is biasing the pivot member 27 vertically upward, the chain 31 is placed under tension as further upward movement is prevented by the stabilizer member 1. The plow is thus held in an immobile position and is prevented from bouncing up into the air and jerking the chain when driving over a bumpy road or other undulation. In this way, the possibility of the plow snapping the chain by violently bouncing up and down over bumps or the likelihood that the chain will be unhooked from either the pivot member 27 or pivotable section 28 is greatly reduced.

During plowing, it is desirable for the plow to have a full and complete range of vertical motion. To facilitate this, an actuation cable 11 or other suitable control device is provided so that the operator of the vehicle can raise and lower the stabilizer member 1, as desired, from its lowered operative position to its raised inoperative position. A first end of the elongate actuator cable 11, slidably movable within a protective sheath 13, is clamped to the stabilizer member 1 by a suitable clamp or other attachment device 12, while the first end of the sheath 13 may be secured to the vertical mounting frame 30. The cable 11 may be attached to either one of the first and second sleeves 2, 3 by any suitable manner, e.g. by welding, clamping, etc., but preferably the attachment is releasable to facilitate replacement of the cable if it breaks.

The second end of the actuation cable 11 terminates in tee member 24 and is located within the passenger compartment of the vehicle 25. The second end of the sheath 13 is secured to the interior of the passenger compartment such that any relative pushing or pulling motion between the tee member 24 and the sheath 13 produces a corresponding pushing or pulling motion on the stabilizer member 1 thereby raising and lowering the stabilizer member 1 into its inoperative and operative positions. As the tee member 24 will be biased toward the second end of the sheath 13, due to the gravitational force acting on the stabilizer member 1, a locking device, such as a releasable clamp, may be provided within the passenger compartment for releasable engaging the tee member 24 when in its extended position. Alternatively, if there is enough friction between the actuation cable 11 and the sheath 13, there will not be relative movement between those two members, due to the gravitational force acting on the stabilizer member 1, and the locking device is not necessary.

It is also to be appreciated that the stabilizer member 1 may be pivoted up and down about the hinge 5 by any other suitable actuating mechanism such as a hydraulic or pneumatic cylinder engaging the stabilizer member 1, or an electric motor that drives a winch or a threaded actuating rod attached to the stabilizer member 1. If the cable 11 is stiff enough or if a push rod is attached to the first end of the cable, the cable may be located beneath the stabilizer member 1 to push the stabilizer into its raised inoperative position. Another possibility is for the stabilizer member 1 to be either pneumatically, hydraulically, or mechanically driven by other suitable means.

Figure 3:
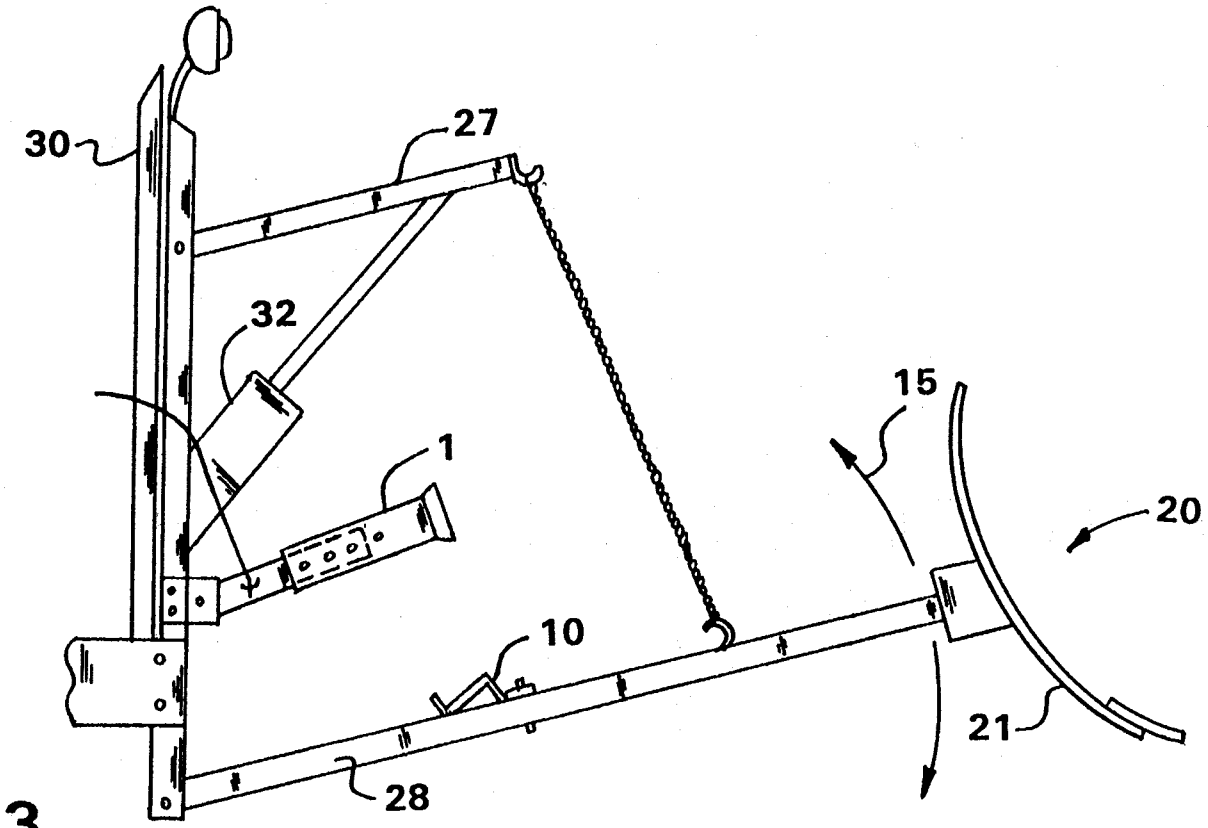
FIG. 3 is side elevational view of a stabilizer member according to the invention in combination with a snow plow showing the stabilizer member in its inoperative raised position; and, FIG. 4 is a side elevation view of the stabilizing member showing an adjustment flange and adjusting bolt.

Thus, when the stabilizer member 1 is in its raised inoperative position, it does not abut against the stop bracket 10 and thereby allows a full and complete range of vertical motion of the plow 20. FIG. 3 shows the stabilizer member 1 in its raised inoperative position in which the stabilizer member 1 is clear of the stop bracket 10. With the stabilizer member 1 is in its raised position, the plow 20 may be freely and fully raised and lowered as indicated by the arrow 15.

Figure 4:
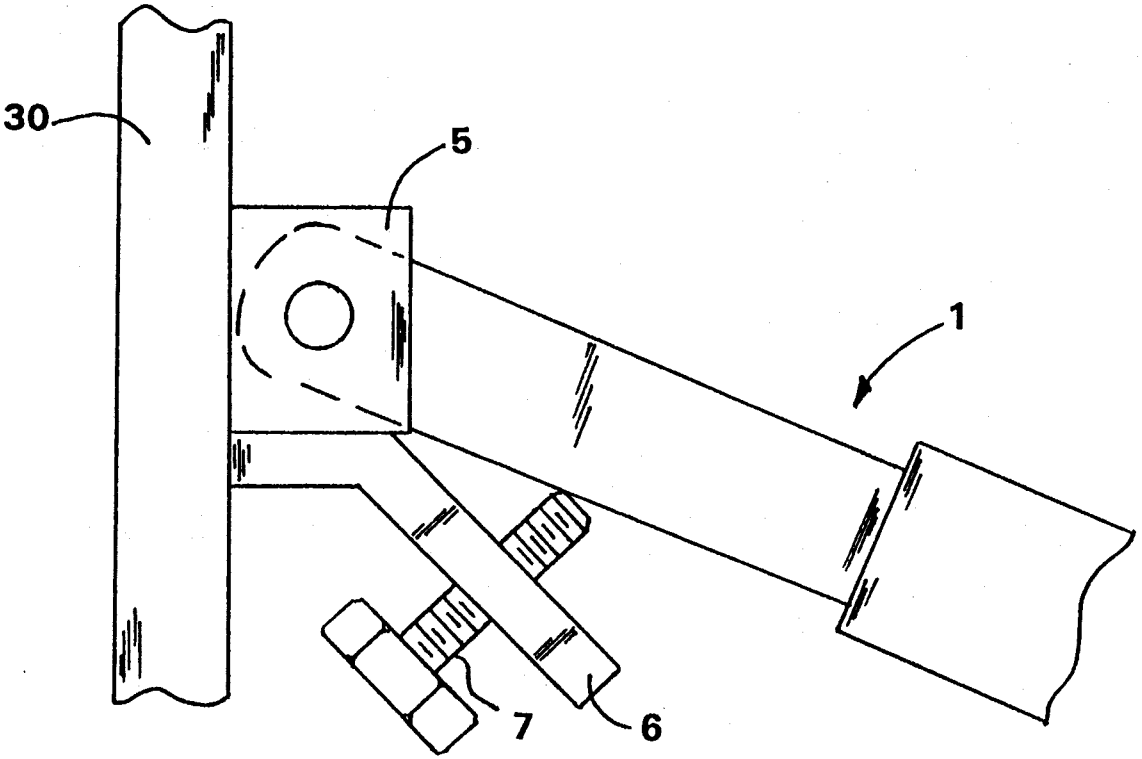

In order to ensure that the stabilizer member 1 is accurately positioned at its lowered operative position to abut against the stop bracket 10, an adjustment flange 6 is secured to the underside of the hinge member 5 and an adjusting bolt or screw 7 is screwed in a threaded aperture in the flange 6, as shown in FIG. 4. A first surface of the screw 7 abuts up against the underside of the stabilizer member 1 and forms an adjustable stop for adjusting the lower pivoted position of the stabilizer member 1.

A resilient bumper 9 is attached, by a screw 18 or other appropriate attachment means, to the second end of the stabilizer member 1 to cushion or damp the abutment between the second end of the stabilizer member 1 and the stop bracket 10. It is to be appreciated that the resilient bumper 9 may be made out of any suitable resilient material which is relatively hard, durable, resistent to weathering, sun, salt, etc. and does not become brittle at cold temperatures, such as hard rubber.

As described above, the present invention prevents the plow 20 from undesired bouncing and/or snapping the chain 31 in a simple and effective manner, thereby protecting the plow implement 21, the plow mounting frame 30, the vehicle 25 and the vehicle occupants from harm that may result if the chain breaks or becomes unhitched from the plow while the vehicle is traveling down a road.

What is claimed is:

1. An apparatus, for stabilizing a plowing implement mounted on a motor vehicle, comprising:

a stabilizer member having first and second opposed ends;

an attachment device supported by said first end of said stabilizer member for attaching said stabilizer member to a plowing frame secured to a motor vehicle, said attachment device allowing movement of said stabilizer member; and said second end of said stabilizer member having an abutment surface for abutting against a pivotable portion of said plowing implement when said plowing implement is raised to a travel position whereby, when said stabilizer member abuts against a pivotable portion of said plowing implement, said stabilizer member minimizes undesired bouncing of said plowing implement, from said travel position, while said vehicle is traveling on a roadway.

2. An apparatus according to claim 1, wherein said rigid stabilizer member has an adjustable length.

3. An apparatus according to claim 2, wherein said stabilizer member comprises first and second sleeves and means for locking the position of said first sleeve relative to said second sleeve.

4. An apparatus according to claim 3, wherein said means for locking the relative position of said first sleeve relative to said second sleeve comprises a plurality of holes located along the length of one of said first and second sleeves and at least one additional hole provided along the length of the other of said first and second sleeves; and a locking member for passing through a pair of aligned holes of said first and second sleeves for securing the relative position of said first and second sleeves.

5. An apparatus according to claim 1, wherein said rigid stabilizer member has a fixed length.

6. An apparatus according to claim 1, wherein said abutment surface comprises a resilient bumper securely attached to said second end of said stabilizing member.

7. An apparatus according to claim 6, wherein said resilient bumper is manufactured from rubber.

8. An apparatus according to claim 1, wherein a control mechanism is provided for controlling movement of said stabilizer member into its raised inoperative position and its lower operative position.

9. An apparatus according to claim 8, wherein said control mechanism comprises an elongate cable housed within a protective sheath, a first end of said elongate cable is secured to said stabilizer member and a second opposed end of said elongate cable is located within the passenger compartment of a vehicle, and relative movement between said elongate cable and said protective sheath causes said stabilizer member to pivot into one of its raised inoperative position and its lower operative position.

10. An apparatus according to claim 1, wherein said apparatus further comprises a stop bracket mounted on said pivotable portion, said stop bracket is positioned to be engageable with said abutment surface of said stabilizer member, when said stabilizer member is in its lower operative position and a plow, to which said stabilizer member is pivotable attached, is partially raised into its travel position.

11. An apparatus according to claim 1, wherein said stabilizer member includes means for adjusting a position of the lower operative position of said stabilizer member.

12. An apparatus according to claim 11, wherein said means for adjusting the lower operative position of said stabilizer member comprises a flange attached to said attachment device, a threaded hole extends through said flange, and an adjusting screw is located within said threaded hole for engaging said stabilizer member and adjusting the lower operative position of said stabilizer member.

13. An apparatus according to claim 1, wherein said stabilizer member is rigid and said movement of said stabilizer member is a vertical pivoting motion.

14. A method of stabilizing a plowing implement mounted on a motor vehicle comprising the steps of:

employing a rigid stabilizer member having first and second opposed ends;

pivotably attaching said first end of said stabilizer member to a plowing frame secured to a motor vehicle;

providing said second end of said stabilizer member with an abutment surface for abutting against a pivotable portion of said plowing implement when said plowing implement is raised to a travel position, moving said stabilizer member into an operative position; and raising said plowing implement to its travel position so that said abutment surface abuts against a pivotable portion of said plowing implement thereby to minimize undesired bouncing of said plowing implement, from said travel position, while the vehicle is traveling on a roadway.

15. A stabilizing apparatus in combination with a plowing implement comprising a vertical mounting frame securable to a front end of a vehicle by suitable attachment means, an upper end portion of said vertical mounting frame having a first end of a pivot member pivotably mounted thereto while a second end of said pivot member supports a first hook, a lower end portion of said vertical mounting frame having a first end of a pivotable section pivotably mounted thereto while an intermediate section of said pivotable section supports a second hook, a second end of said pivotable section supports said plowing implement, a first end of a hydraulic cylinder is pivotably mounted to said vertical mounting frame while a second end of said hydraulic cylinder is connected to said second end of said pivot member, and a chain interconnects said first and second hooks, said stabilizing apparatus comprising:

a stabilizer member having first and second opposed ends; and, an attachment device supported by said first end of said stabilizer member for attaching said stabilizer member to one of said vertical mounting frame and said pivotable section of said plowing implement, said attachment device allowing desired movement of said stabilizer member;

said second end of said stabilizer member having an abutment surface for abutting against the other of said pivotable section of said plowing implement and said vertical mounting frame when said plowing implement is raised to a travel position whereby when said stabilizer member abuts against said pivotable section of said plowing implement, said stabilizer member minimizes undesired bouncing of said plowing implement, from said travel position, while the vehicle is traveling on a roadway.

* * * * *